United States Patent [19]

Matthews

[11] Patent Number: 4,514,033

[45] Date of Patent: Apr. 30, 1985

[54] ARC WELDING CLAMP

[76] Inventor: Charles G. Matthews, 1647 Semmes, Memphis, Tenn. 38114

[21] Appl. No.: 544,470

[22] Filed: Oct. 24, 1983

[51] Int. Cl.[3] ..... H01R 11/22

[52] U.S. Cl. ..... 339/255 P; 339/261

[58] Field of Search ..... 339/61, 200 P, 255 P, 339/260, 261

[56] References Cited

U.S. PATENT DOCUMENTS 2,522,810 9/1950 Bailey ..... 339/255 P

*Primary Examiner*—Joseph H. McGlynn

*Attorney, Agent, or Firm*—Walker & McKenzie

[57] ABSTRACT

An arc-welding clamp for electrically joining an electrically conductive cable to an electrically conductive workpiece. The clamp includes electrically nonconductive handle members pivotally joined to one another so that the workpiece can be clamped between the distal ends thereof. One of the handle members is provided with an electrically conductive jaw member coupled to the cable for making electrical contact with the workpiece. A spring member presses against the proximal ends of the handle members. One end of the spring member presses the cable against one of the handle members.

7 Claims, 13 Drawing Figures

ARC WELDING CLAMP

BACKGROUND OF THE INVENTION

1. Field of the Invention

The present invention relates to arc welding clamps for electrically joining an electrically conductive cable to an electrically conductive workpiece.

2. Description of the Prior Art

Heretofore, various arc welding clamps have been developed. See, for example, Matthews, U.S. Pat. No. 3,648,016 invented by the present inventor and relating to an arc welding electrode holder. The present inventor is aware of various other electrical clamps. See, for example, Davidson, U.S. Pat. No. 2,918,646; Carbonneau, U.S. Pat. No. 3,644,877; Anderson, U.S. Pat. No. 3,737,832; and Zehr, U.S. Pat. No. 3,850,490. None of the above patents disclose or suggest the present invention.

SUMMARY OF THE INVENTION

The present invention is directed toward providing an improved arc welding clamp for electrically joining an electrically conductive cable to an electrically conductive workpiece. The concept of the present invention is to provide an arc welding clamp in which no eddy currents or the like are produced as the electrically conductive cable is electrically joined to the electrically conductive workpiece.

The arc welding clamp of the present invention comprises, in general, an electrically nonconductive first member, an electrically nonconductive second member, an electrically conductive jaw member for being mounted on the first end of the first member and for being electrically coupled to an electrically conductive cable, pivot means for pivotally coupling the first and second members to one another intermediate the first and second ends thereof, and spring means for urging the first ends of the first and second members toward one another to clamp an electrically conductive workpiece between the first end of the second member and the electrically conductive jaw member, the spring means including a spring member having a first end for pressing the cable against the second end of the first member and having a second end for pressing against the second end of the second member.

DESCRIPTION OF THE PREFERRED EMBODIMENTS

Figure 1:
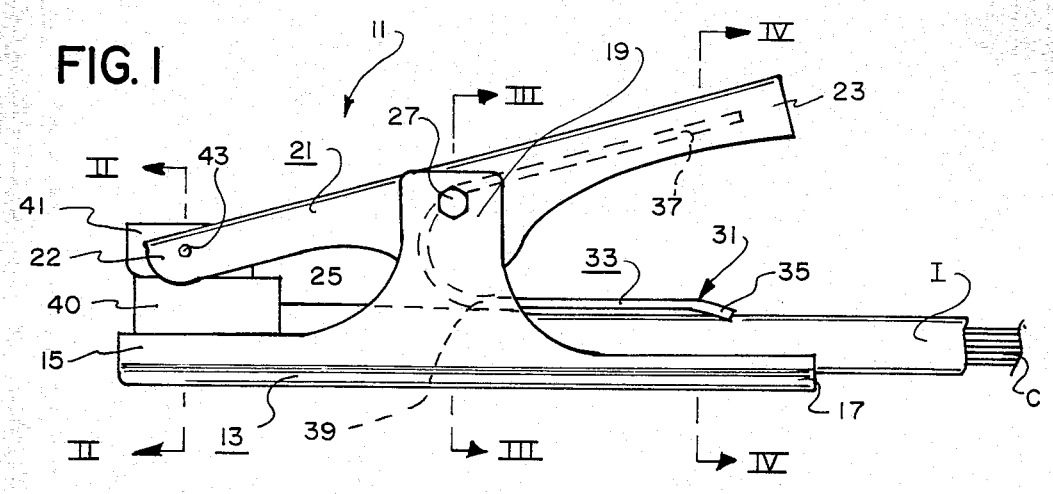
FIG. 1 is a side elevational view of a first embodiment of the arc welding clamp of the present invention shown with an electrically conductive cable attached thereto.
Figure 2:
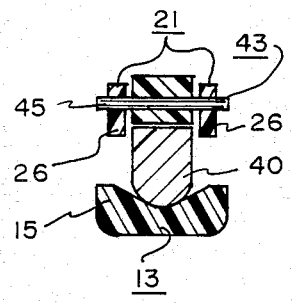
FIG. 2 is a sectional view substantially as taken on line II—II of FIG. 1.
Figure 3:
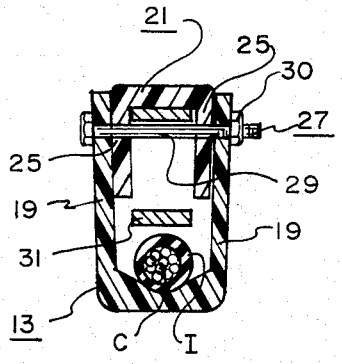
FIG. 3 is a sectional view substantially as taken on line III—III of FIG. 1 with portions thereof omitted for clarity.
Figure 4:
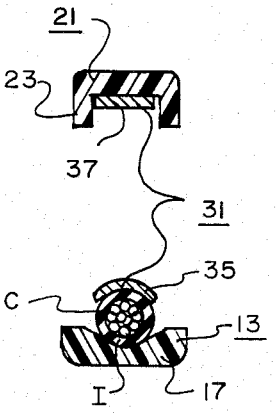
FIG. 4 is a sectional view substantially as taken on line IV—IV of FIG. 1 with portions thereof omitted for clarity.
Figure 5:
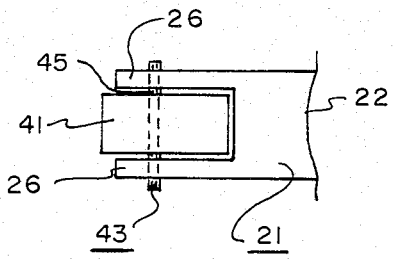
FIG. 5 is a top plan view of a portion of the arc welding clamp of FIG. 1.
Figure 6:
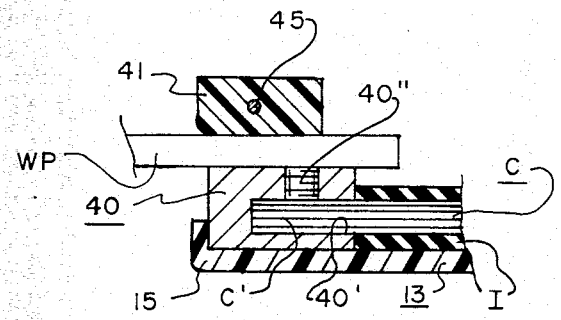
FIG. 6 is a somewhat diagrammatic sectional view of a portion of the arc welding clamp of FIG. 1 showing a workpiece being electrically coupled to the electrically conductive cable.
Figure 7:
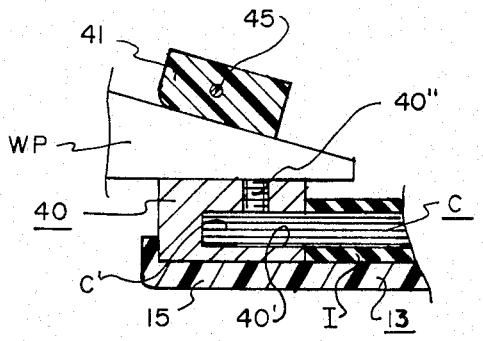
FIG. 7 is somewhat similar to FIG. 6 but shows a workpiece of a different shape being electrically coupled to the electrically conductive cable.
Figure 8:
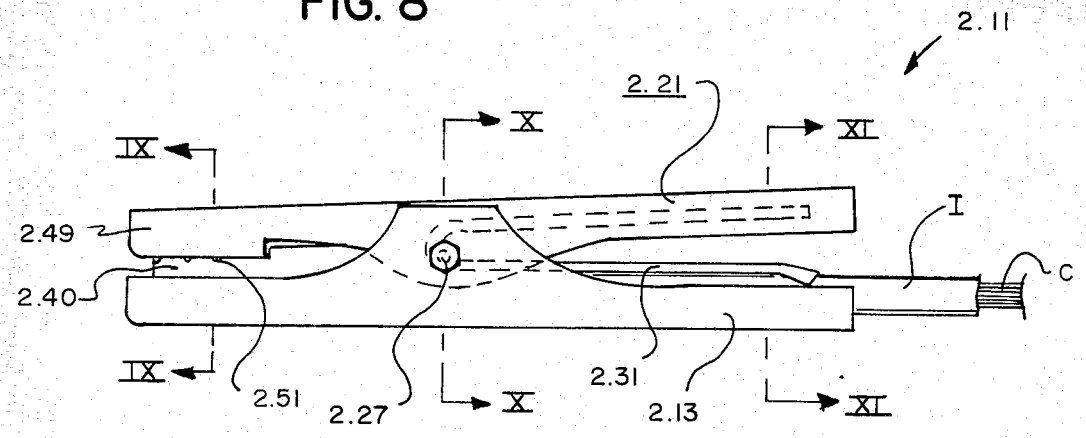
FIG. 8 is a side elevational view of a second embodiment of the arc welding clamp of the present invention.
Figure 9:
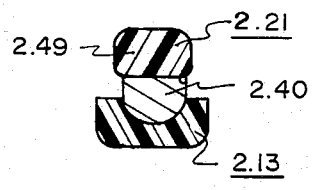
FIG. 9 is a sectional view substantially as taken on line IX—IX of FIG. 8.
Figure 10:
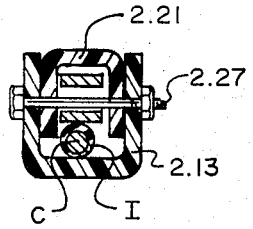
FIG. 10 is a sectional view substantially as taken on line X—X of FIG. 8.
Figure 11:
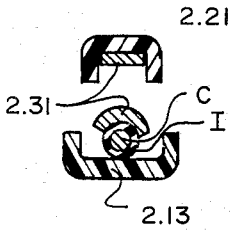
FIG. 11 is a sectional view substantially as taken on line XI—XI of FIG. 8 with portions thereof omitted for clarity.
Figure 12:
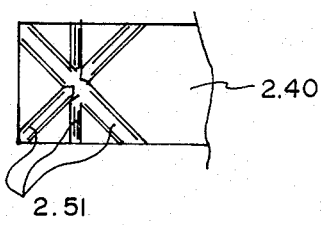
FIG. 12 is a top plan view of a portion of the arc welding clamp of FIG. 8.
Figure 13:
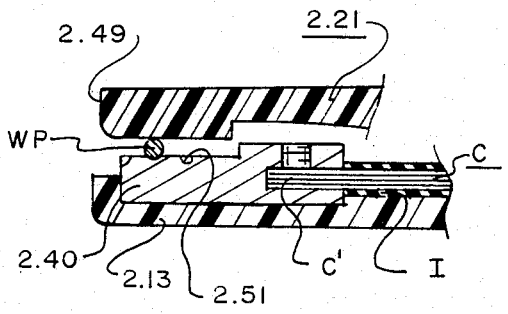
FIG. 13 is a somewhat diagrammatic sectional view of a portion of the arc welding clamp of FIG. 8, showing a workpiece being electrically coupled to the electrically conductive cable.

The arc welding clamp of the present invention is for use in a typical arc welding process to electrically join an electrically conductive cable C to an electrically conductive workpiece WP. The cable C is provided with the typical electrically nonconductive insulation I. The workpiece WP may consist of a piece of metal or the like to be welded as indicated in FIGS. 6 and 7 or may consist of an electrode for use in the welding process as indicated in FIG. 13.

A first embodiment of the arc welding clamp of the present invention is shown in FIGS. 1–7 and indicated by the numeral 11. The clamp 11 includes an electrically nonconductive first member 13 having a first end 15 and a second end 17. A pair of normally upstanding ear members 19 is preferably provided on the first member 13 intermediate the first and second ends 15, 17. The first member 13 may be constructed in any manner apparent to those skilled in the art such as by being molded or cast out of a plastic material or the like.

The clamp 11 includes an electrically nonconductive second member 21 having a first end 22 and a second end 23. A pair of normally downwardly extending ear members 25 are preferably provided on the second member 21 intermediate the first and second ends 22, 23 thereof for coacting with the ear members 19 of the first member 13 in a manner which will hereinafter become apparent. A pair of normally forwardly directed ear members 26 are preferably provided on the first end 22 (see FIG. 5) for reasons which will become apparent. The second member 21 may be constructed in any manner apparent to those skilled in the art such as by being cast or molded from the plastic material or the like.

The clamp 11 includes a pivot means 27 for pivotally coupling the first and second members 13, 21 to one another intermediate the first and second ends thereof. The pivot means 27 may include a pivot rod 29 for extending through the ear members 19, 25 of the first and second members 13, 21 as clearly shown in FIG. 3 to thereby pivotally attach the first and second members 13, 21 to one another. The pivot rod 27 may simply consist of a typical bolt or the like and a typical nut 30 may be used therewith to secure it to the first and second members 13, 21.

The clamp 11 includes a spring means 31 for urging the first ends 15, 22 of the first and second members 13, 21 toward one another. The spring means 31 includes a spring member 33 having a first end 35 for pressing the cable C against the second end 17 of the first member and having a second end 37 for pressing against the second end 23 of the second member 21, thereby urging the second ends 17, 23 of the first and second members 13, 21 away from one another and urging the first ends 15, 22 of the first and second members 13,21 toward one another. The spring member 33 may consist of a substantially, flat ribbon-type spring being substantially U-shaped from the side (see FIG. 1) having a bight portion 39 intermediate the first and second ends 35, 37 thereof for extending around the pivot rod 29. The first end 35 of the spring member 33 is preferably shaped so as to contiguously engage the cable C. Thus, the spring member 33 preferably is substantially rectangular in cross-sectional shape except at the first end 35 thereof where it is substantially curved or circular in cross-sectional shape as clearly shown in FIG. 4 to contiguously engage the substantially circular in cross-sectional shape cable C.

The clamp 11 includes an electrically conductive jaw member 40 for being mounted on the first end 15 of the first member 13 and for being electrically coupled to the cable C. The jaw member 40 may be mounted on the first end 15 in any manner apparent to those skilled in the art such as, for example, fitting within a concave portion on the normally upwardly directed side of the first end 15 (see, in general, FIGS. 2, 6 and 7). The jaw member 40 may have an aperture 40' therein for receiving the end C' of the cable C with the insulation I removed therefrom (see FIGS. 6 and 7). A set screw 40'' may be provided to securely attach the end C' of the cable C to the jaw member 40 and to insure that there is a good electrical connection between the cable C and the jaw member 40. The jaw member 40 may be constructed in any manner apparent to those skilled in the art such as by being machined out of an electrically conductive metal such as brass.

The clamp 11 preferably includes an electrically nonconductive jaw member 41 for being attached to the first end 22 of the second member 21 and for coacting with the electrically conductive jaw member 40 to clamp the workpiece WP therebetween. A pivot means 43 is preferably provided for pivotally coupling the electrically nonconductive jaw member 41 to the first end 22 of the second member 21. The pivot means 43 preferably includes a pivot rod 45 for extending through the pair of forwardly directed ear members 26 provided on the first end 22 of the second member 21, and through the electrically nonconductive jaw member 41 to thereby pivotally attach the jaw member 41 to the first end 22 of the second member 21. The jaw member 41 may be constructed in any manner apparent to those skilled in the art such as by being molded or cast out of a plastic material or the like. The pivoting action of the electrically nonconductive jaw member 41 allows the clamp 11 to securely hold workpieces WP having parallel walls as shown in FIG. 6 or having nonparallel walls as shown in FIG. 7.

A second embodiment of the arc welding clamp of the present invention is shown in FIGS. 8–13 and identified by the numeral 2.11. The clamp 2.11 is substantially similar to the clamp 11 and includes a first member 2.13, a second member 2.21, a pivot means 2.27 for pivotally connecting the first and second members 2.13, 2.21, a spring means 2.31 for urging the first ends of the first and second members 2.13, 2.21 toward one another to clamp the workpiece WP therebetween, and an electrically conductive jaw member 2.40. The clamp 2.11 is designed specially for typical arc welding electrodes and, therefore, does not include the pivotally mounted electrically nonconductive jaw member 41 of the clamp 11. Thus, rather than the pivotally mounted electrically nonconductive jaw member 41, the first end of the second member 2.21 is preferably formed to define an electrically nonconductive jaw member 2.49 for coacting with the electrically conductive jaw member 2.40 to clamp the workpiece WP therebetween. The electrically conductive jaw member 2.40 may include a plurality of substantially V-shaped grooves 2.51 there across as clearly shown in FIG. 12 for coacting with the arc welding electrode-type workpiece WP. For a more detailed discussion of the construction and operation of the various components of the clamp 2.11, reference should be made to the above description of the substantially similar components of the clamp 11.

The use and operation of the arc welding clamp of the present invention is quite simple. With the electrically conductive cable securely attached to the electrically conductive jaw means, the second ends of the first and second members act as handles and are squeezed together to cause the first ends thereof to spread apart. The electrically conductive workpiece is then positioned between the jaw members at the first ends of the first and second members, and the second ends are then released, causing the workpiece to be clamped between the jaw members.

The arc welding clamp of the present invention provides a means for electrically joining an electrically conductive cable to an electrically conductive workpiece during a typical arc welding process that maintains the electrically conductive cable in a substantially straight position with the flow of electrical current therethrough traveling to the workpiece without creating any eddy currents, shorts or the like. The manner in which the electrically conductive cable is attached to the electrically conductive jaw member also reduces the tendency in prior arc welding clamps of the cable breaking at the junction between the cable and clamp. Thus, by attaching the cable to the electrically conductive jaw at the forward end of the clamp (i.e., at the first end 15 of the first member 13) and having the spring means 31 press the cable against the rearward end of the clamp (i.e., against the second end 17 of the first member 13) a substantial length of the cable is supported by the clamp to thereby reduce any bending forces or the like to which the cable may be subjected to at the location where it is electrically coupled to the clamp.

It will be understood from the foregoing that all of the electrical current load produced by any electrical arc welding machine on any polarity will transfer through the ground connector or the electrode holder to the workpiece up to the maximum capacity of the electrical arc welding machine without interferences that are known by this inventor as factors. These interferences are magnetic fields producing magnetic current, causing electrodes to stick, producing arc blow irregularities, impurities, crackwelds, etc. which have caused uncontrollable costs until the above discovery. These discoveries were unknown to others.

Although the present invention has been described and illustrated with respect to preferred embodiments thereof and preferred use therefore, it is not to be so limited since changed and modifications can be made therein which are within the full intended scope of the invention.

I claim:

1. An arc-welding clamp for electrically joining an electrically conductive cable to an electrically conductive workpiece, said clamp comprising:

(a) an electrically nonconductive first member having first and second ends;

(b) an electrically nonconductive second member having first and second ends;

(c) an electrically conductive jaw member for being mounted on said first end of said first member and for being electrically coupled to the cable;

(d) pivot means for pivotally coupling said first and second members to one another intermediate said first and second ends thereof; and (e) spring means for urging said first ends of said first and second members toward one another, said spring means including a spring member having a first end for pressing the cable against said second end of said first member and having a second end for pressing against said second end of said second member.

2. The clamp of claim 1 in which said first end of said spring member is shaped so as to contiguously engage the cable.

3. The clamp of claim 2 in which said pivot means includes a pivot rod for extending through said first and second members intermediate said first and second ends thereof to pivotally attach said first and second members to one another; and in which said spring member is substantially U-shaped, having a bight portion extending around said pivot rod.

4. The clamp of claim 3 in which said spring member is substantially rectangular in cross-sectional shape except at said first end thereof.

5. The clamp of claim 4 in which the cable is substantially circular in cross-sectional shape; and in which the side of said first end of said spring member that presses the cable against said second end of said first member is substantially curved in cross-sectional shape so as to contiguously engage the cable.

6. The clamp of claim 1 in which is included an electrically nonconductive jaw member for being attached to said first end of said second member and for coacting with said electrically conductive jaw members to clamp the electrically conductive workpiece therebetween; and in which is included a jaw pivot means for pivotally coupling said electrically nonconductive jaw member to said first end of said second member.

7. The clamp of claim 6 in which said jaw pivot means includes a pivot rod for extending through said electrically nonconductive jaw member and portions of said first end of said second member.

* * * * *